US006951293B2

(12) United States Patent
Thibaut

(10) Patent No.: US 6,951,293 B2
(45) Date of Patent: Oct. 4, 2005

(54) END CLOSURE WITH ANTI-ROTATION TAB

(75) Inventor: Michel Thibaut, Parc le Bilaa (FR)

(73) Assignee: Rexam Beverage Can Company, Chicago, IL (US)

( * ) Notice: Subject to any disclaimer, the term of this patent is extended or adjusted under 35 U.S.C. 154(b) by 14 days.

(21) Appl. No.: 10/349,153

(22) Filed: Jan. 22, 2003

(65) Prior Publication Data

US 2004/0140309 A1 Jul. 22, 2004

(51) Int. Cl.[7] ..... B65D 17/34
(52) U.S. Cl. ..... 220/268; 220/270; 220/906
(58) Field of Search ..... 220/268, 269, 220/270, 906

(56) References Cited

U.S. PATENT DOCUMENTS

| | | | | |
|---|---|---|---|---|
| 3,780,902 | A | | 12/1973 | Hole |
| 3,941,276 | A | | 3/1976 | Patel |
| 3,967,754 | A | | 7/1976 | Ostrem |
| 4,276,993 | A | | 7/1981 | Hasegawa |
| 4,363,419 | A | | 12/1982 | Walz, Sr. |
| 4,416,389 | A | | 11/1983 | Wilkinson et al. |
| D289,017 | S | | 3/1987 | Spangler et al. |
| 4,733,793 | A | | 3/1988 | Moen |
| 4,804,104 | A | | 2/1989 | Moen |
| 4,930,658 | A | | 6/1990 | McEldowney |
| 5,129,541 | A | | 7/1992 | Voigt et al. |
| 5,131,555 | A | * | 7/1992 | DeMars et al. ..... 220/269 |
| 5,224,618 | A | * | 7/1993 | Garbiso ..... 220/269 |
| 5,248,053 | A | * | 9/1993 | Lundgren ..... 220/269 |
| 5,494,184 | A | | 2/1996 | Noguchi et al. |
| 5,655,678 | A | * | 8/1997 | Kobayashi ..... 220/269 |
| 5,741,105 | A | | 4/1998 | Schubert et al. |
| 5,799,816 | A | | 9/1998 | Schubert |
| 6,053,349 | A | | 4/2000 | Griggs, Jr. et al. |

FOREIGN PATENT DOCUMENTS

| | | |
|---|---|---|
| JP | 08053131 | 2/1996 |
| WO | WO 0071430 | 11/2000 |

* cited by examiner

*Primary Examiner*—John A. Ricci
(74) *Attorney, Agent, or Firm*—Wallenstein Wagner & Rockey, Ltd.

(57) ABSTRACT

An end closure for a container providing a tab with increased resistance to rotation upon a rivet is disclosed. The end closure has a central panel wall having a product side, a public side, a rivet, and a displaceable tear panel in the central panel wall at least substantially defined by a frangible score and a non-frangible hinge segment. A tab is attached to the public side of the central panel wall by the rivet. At least a nose portion of the tab extends over a portion of the tear panel. A lift end of the tab is opposite the tab nose. The tab has a central webbing between the nose and the lift end. The central webbing has an anti-rotation member in communication with the public side of the central panel wall. The anti-rotation member provides a spring force against the central panel wall.

27 Claims, 8 Drawing Sheets

END CLOSURE WITH ANTI-ROTATION TAB

TECHNICAL FIELD OF THE INVENTION

The present invention relates to end closures for two-piece beer and beverage metal containers, having a frangible tear panel and a retained-tab secured by a rivet. More specifically, the present invention relates to improved characteristics for limiting retained-tab rotation.

BACKGROUND OF THE INVENTION

Typical end closures for beer and beverage containers have an opening panel and an attached leverage tab for pushing the opening panel into the container to open the end. The container is typically a drawn and ironed metal can, usually constructed from a thin plate of aluminum or steel. End closures for such containers are also typically constructed from a cutedge of thin plate of aluminum, formed into a blank end, and manufactured into a finished end by a process often referred to as end conversion. These ends are formed in the process of first forming a cutedge of thin metal, forming a blank end from the cutedge, and converting the blank into an end closure which may be seamed onto a container.

These types of container ends have been used for many years, with almost all such ends in use today being the "ecology" or "stay-on-tab" ("SOT") ends in which the tab remains attached to the end after a tear panel, including large-opening ends ("LOE"), is opened. The tear panel being a portion of the can end defined by a score length. The tear panel may be opened, that is the score may be severed, and the tear panel displaced at an angular orientation relative to the remaining portion of the can end. The tear panel remains hingeably connected to the remaining portion of the can end by a hinge segment, leaving an opening through which the user draws the contents of the container. In an LOE, the opening is at least 0.5 square inches in area.

Opening of the tear panel is operated by the tab which is attached to the can end by a rivet. The tab is attached to the can end such that a nose of the tab extends over a proximal portion of the tear panel. A lift end of the tab is located opposite the tab nose and provides access for a user to lift the lift end, such as with the user's finger, to force the nose against the proximal portion of the tear panel.

When the tab nose is forced against the tear panel, the score initially ruptures at a vent region of the score. This initial rupture of the score is primarily caused by the lifting force on the tab resulting in lifting of a central region of the can end, immediately adjacent the rivet. As the tab is lifted further, the score rupture propagates along the length of the score, eventually stopping at the hinge segment.

One problem associated with the SOT and LOE ends is rotation of the tab on the rivet in a clockwise or counter-clockwise direction prior to opening. When the tab rotates on the rivet, the probability of an opening failure increases. An opening failure is defiled as an instance when the can end is opened in a manner other than that described above, or when the container cannot be opened using the SOT (i.e., some force must be supplied by an instrument other than the SOT).

One method aimed at eliminating tab rotation includes placing an "up" dimple on the can end near the rivet area. The up dimple is aligned with, and fits within, a small hole on the tab. The up dimple is created by tooling that strikes the product or beverage side of the can end. One drawback of this proposed solution is that the tooling that creates the up dimple damages a film that coats the product side of the can end, and such damage might allow direct contact between the metal of the can end and the contents of the container.

As is explained in greater detail below, the present invention reduces or eliminates these problems.

SUMMARY OF THE INVENTION

It is an object of the present invention to provide an end closure for a container having a central panel wall with a product side and a public side. The public side of the central panel wall includes a rivet and a displaceable tear panel at least substantially defined by a frangible score and a non-frangible hinge segment. A tab is attached to the public side of the central panel wall by the rivet. A nose portion of the tab extends over a portion of the tear panel. A lift end of the tab is located opposite the tab nose. The tab also includes a central webbing between the nose and the lift end. The central webbing has an anti-rotation member in communication with the public side of the central panel wall. A spring force provided by the anti-rotation member against the central panel wall increases a torque required to rotate the tab on the rivet.

It is also an object of the invention to provide an end closure for a container having a central panel wall with a product side and a public side. The public side of the central panel wall includes a rivet and a displaceable tear panel at least substantially defined by a frangible score and a non-frangible hinge segment. A tab is attached to the public side of the central panel wall by the rivet. A nose portion of the tab extends over a portion of the tear panel. A lift end of the tab is located opposite the tab nose. The tab also includes a central webbing between the nose and the lift end. The central webbing has an anti-rotation member in communication with the public side of the central panel wall. A detent is located on the central panel wall in alignment with the anti-rotation member. The anti-rotation member is received within the detent to increase a torque required to rotate the tab on the rivet.

Other advantages and aspects of the invention will become apparent upon making reference to the specification, claims, and drawings to follow.

DETAILED DESCRIPTION OF THE DRAWINGS

Figure 1:
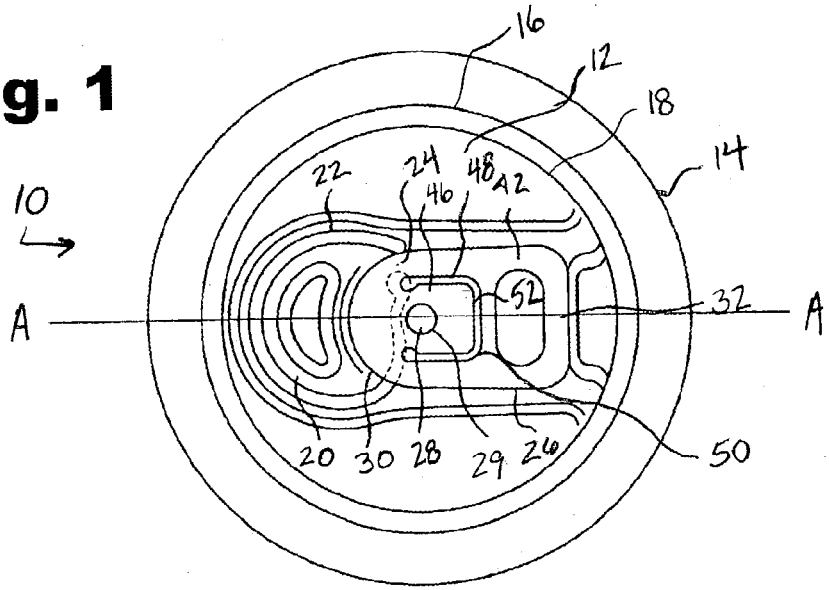
FIG. 1 is a plan view of the public side of an end closure of one embodiment of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The Figures show the article of the present invention, made according to the manufacturing method of the invention. The container end of the present invention has improved opening characteristics, having structure adapted to provide a stiff center panel region around the central rivet area which serves as the leverage point for opening, and structure adapted to provide improved leverage and smooth openability for the end.

Figure 4:
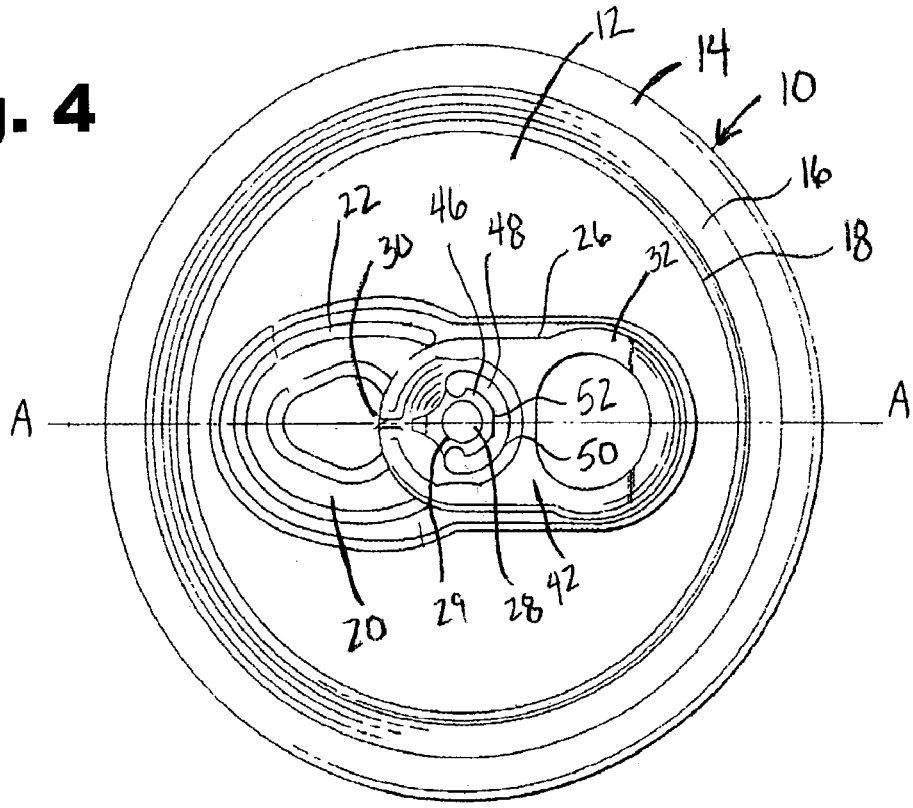
FIG. 4 is a plan view of the public side of an end closure of an alternate embodiment of the present invention.

As shown in FIGS. 1 and 4, the end closure 10 for a container (not shown) has a central panel wall 12 having a seaming curl 14 for joining the wall to the container. The container is typically a drawn and ironed metal can, usually constructed from a thin plate of aluminum or steel. End closures for such containers are also typically constructed from a cutedge of thin plate of aluminum or steel, formed into blank end, and manufactured into a finished end by a process often referred to as end conversion. In the embodiment shown in the Figures, the central panel 12 is joined to a container by a seaming curl 14 which is joined to a mating curl of the container. The seaming curl 14 of the end closure 10 is integral with the central panel 12 by a countersink area 16 which is joined to the panel outer edge 18 of the central panel 12. This type of means for joining the central panel 12 to a container is presently the typical means for joining used in the industry, and the structure described above is formed in the process of forming the blank end from a cutedge of metal plate, prior to the end conversion process. However, other means for joining the central panel to a container may be employed with the present invention.

The steps of manufacturing the end begin with blanking the cutedge, typically a round or non-round cutedge of thin metal plate. Examples of non-round cutedge blanks include elliptical cutedges, and convoluted cutedges. A convoluted cutedge may be described as generally having three distinct diameters, each diameter being 45° relative to the others. The cutedge is then formed into a blank end by forming the seaming curl, countersink, panel radius and the central panel.

The conversion process for this type of end closure includes the following steps: forming a rivet by first forming a projecting bubble in the center of the panel and subsequently working the metal of the bubble into a button and into the more narrow projection of metal being the rivet; forming the tear panel by scoring the metal of the panel wall; forming an inner bead on the tear panel; forming a deboss panel by bending the metal of the panel wall such that a central area of the panel wall is slightly lower than the remaining panel wall; staking the tab to the rivet; and other subsequent operations such as wipe-down steps to remove sharp edges of the tab, lettering on the panel wall by scoring or embossing (or debossing), and restriking the rivet island.

The central panel wall 12 has a displaceable tear panel 20 defined by a frangible score 22 and a non-frangible hinge segment 24. The tear panel 20 of the central panel 12 may be opened, that is the frangible score 22 may be severed and the tear panel 20 displaced at an angular orientation relative to the remaining portion of the central panel 12, while the tear panel 20 remains hingeably connected to the central panel 12 through the hinge segment 24. In this opening operation, the tear panel 20 is displaced at an angular deflection. More specifically, the tear panel 20 is deflected at an angle relative to the plane of the panel 12, with the vortex of the angular displacement being the hinge segment 24.

The tear panel 20 is formed during the conversion process by a scoring operation. The tools for scoring the tear panel 20 in the central panel 12 include an upper die on the public side having a scoring knife edge in the shape of the tear panel 20, and a lower die on the product side to support the metal in the regions being scored. When the upper and lower die are brought together, the metal of the panel wall 12 is scored between the dies. This results in the scoring knife edge being embedded into the metal of the panel wall 12, forming the score which appears as a wedge-shaped recess in the metal. The metal remaining below the wedge-shaped recess is the residual of the score 22. Therefore, the score is formed by the scoring knife edge causing movement of metal, such that the imprint of the scoring knife edge is made in the public side of the panel wall 12.

The central panel 12 further includes a tab 26. The tab 26 has a generally elongated body with a central longitudinal axis A—A defined by a central cross section through the tab nose 30, and through a central webbing 42 and the lift end 32. Typical prior art container ends often have a tab 26 which is staked in the final steps of the conversion process by staking the area of the panel wall 12 adjacent and under the rivet island 46 at an angle, to bias the tab 26 such that the lift end 32 of the tab 26 rests close to the panel wall 12.

The opening of the tear panel 20 is operated by the tab 26 which is attached to the central panel 12 by a rivet 28, generally through a rivet hole 29. The tab 26 is attached to the central panel 12 such that the nose 30 of the tab 26 extends over a proximal portion of the tear panel 20. The lift end 32 of the tab 26 is located opposite the tab nose 30 and provides access for a user to lift the lift end 32, such as with the user's finger, to force the nose 30 against the proximal portion of the tear panel 20.

When the tab nose 30 is forced against the tear panel 20, the score 22 initially ruptures at the vent region of the score 22 of the tear panel 20. This initial rupture of the score 22 is primarily caused by the lifting force on the tab resulting in lifting of a central region of the center panel, immediately adjacent the rivet 28, which causes separation of the residual metal of the score 22. The force required to rupture the score in the vent region, typically referred to as the "pop" force, is a lower degree of force relative to the force required to propagate other regions of the score 22 by continued lifting of the lift end 32 of the tab 26. Therefore, it is preferable for the panel 12 in the area around the rivet 28 only lifts enough to assist with initial score rupture, or "pop," and remains substantially stiff and flat to provide the needed leverage for the tab 26 to propagate the scoreline of the tear panel 20. The present invention provides such optimal stiffness in the center panel, as is explained further below.

After the initial "pop", or venting of the tear panel, the user continues to lift the lift end 32 of the tab 26 which causes the tab nose 30 to be pushed downward on the tear panel 20 to continue the rupture of the score 22, as an opening force. As the opening operation is continued, the tear panel 20 is displaced downward and is rotated about the hinge region 24 to be deflected into the container.

Figure 2:
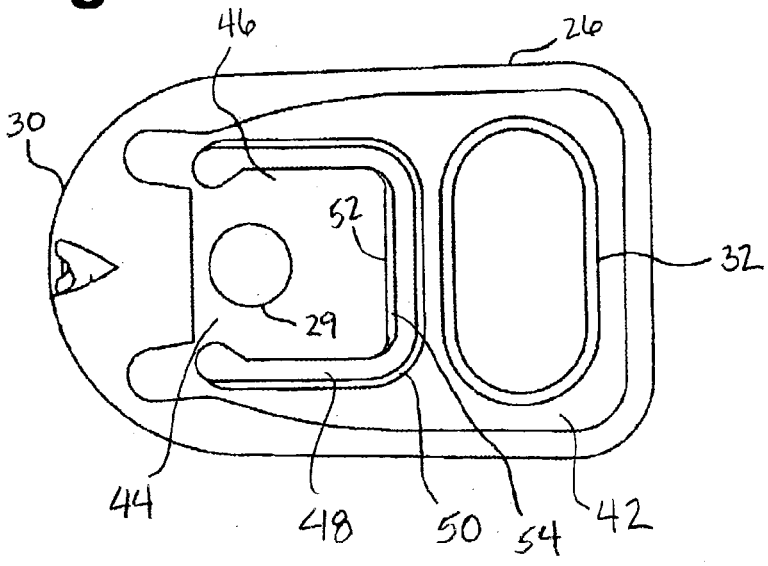
FIG. 2 is a plan view of the under side of the tab shown in FIG. 1.
Figure 5:
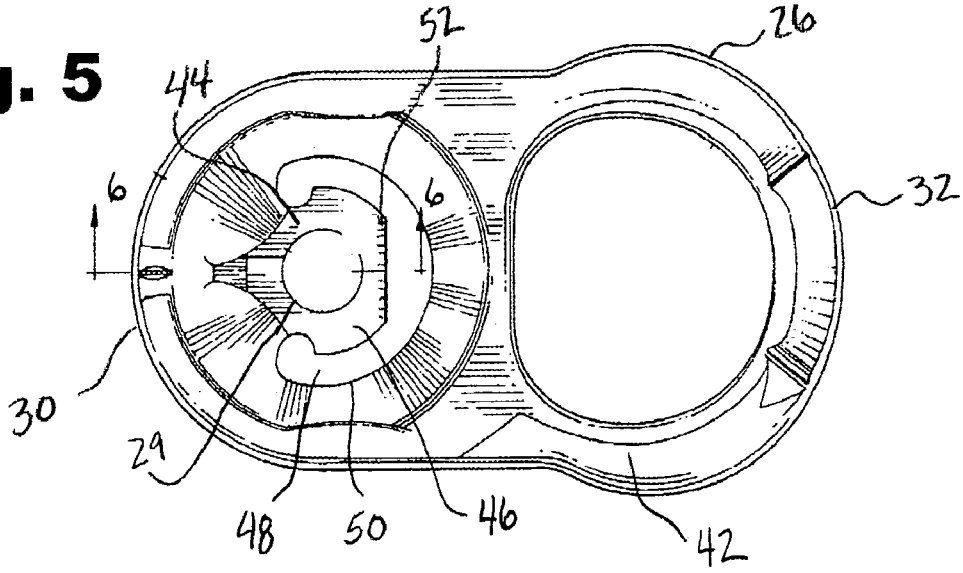
FIG. 5 is a plan view of the top side of the tab shown in FIG. 4.

As is best shown in FIGS. 2 and 5, the tab 26 has a central webbing 42 located between the nose 30 and the lift end 32. The central webbing 42 includes a hinge region 44 and a rivet island 46 surrounding the rivet 28. An opening or void region 48 of the tab webbing 42 provides an exposed area of the central panel 12. The void region 48 has a curvilinear geometry which borders the rivet island 46 and at least partially surrounds the rivet 28 at a generally equal distance, with a first end of the void region 48 being disposed generally to one side of the rivet 28, and a second end being generally disposed on an opposite side of the rivet 28. The hinge region 44 of the tab webbing 42 includes a hinge line which is defined by a substantially straight line passing between the first end and the second end of the void region 48.

Figure 3:
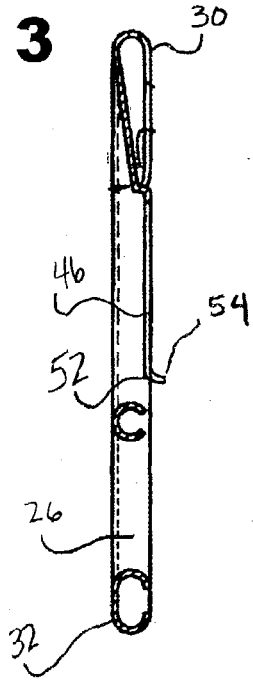
FIG. 3 is a cross-sectional view of the tab shown in FIG. 1.

The void region 48 is generally defined a void region perimeter 52 of the tab webbing 42. The void region 48 can have a U-shaped configuration as illustrated in FIGS. 1–3. In this configuration, the rivet island 46 generally follows the shape of the void and region 48. Accordingly, the rivet island 46 has a substantially linear edge portion 54 opposite the hinge region 44 of the webbing 42.

Figure 6:
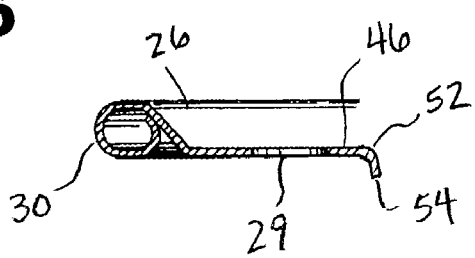
FIG. 6 is a cross-sectional view along 6—6 of FIG. 5.

Alternatively, as illustrated in FIGS. 4–6, the void region 48 may have a generally arch-shaped configuration. In this configuration, the rivet island 46 again follows the general shape of the void region 48.

FIGS. 1–6 represent only two examples of the rivet island 46 configuration. However, those individuals who are ordinary skilled in the art would understand that the rivet island 46 and the void region 48 can take any number of shapes without departing from the spirit of the invention, including but not limited to all notch or lance type rivet islands.

Figure 7:
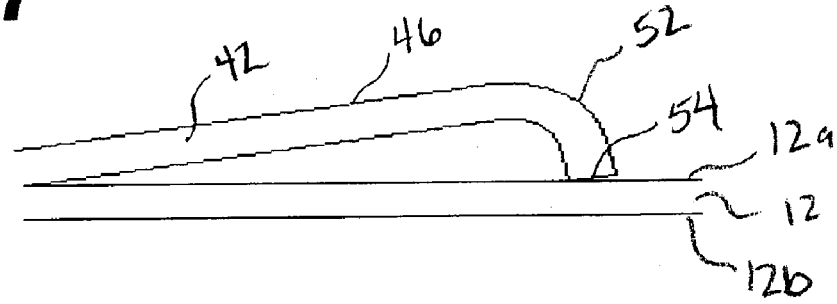
FIG. 7 is a schematic cross-sectional view of an end closure of the present invention.

As shown in FIG. 7, the webbing 42 further comprises an anti-rotation member 52 extending downwardly relative to the public side 12*a* of the central panel 12. The anti-rotation member 52 of FIG. 7 engages a portion of the central panel wall 12 to increase the torque required to rotate the tab 26 about the rivet 28. In this embodiment, the anti-rotation member 52 provides a spring force against the central panel 12. The spring force is achieved by deflecting the webbing 42 relative to the portion of the webbing restrained by the rivet 28. The tendency of the webbing 42 to spring-back forces the anti-rotation member 52 against the public side 12*a* of the central panel 12. The torque required to rotate the tab 26 on the rivet 28 is increased by a frictional force created by the anti-rotation member 52 on the central panel 12. The torque being increased to such an extent that accidental rotation of the tab 26 during handling or shipping is eliminated.

Figure 8:
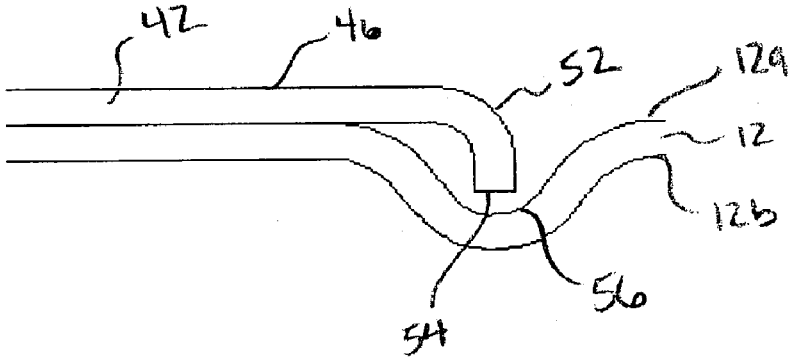
FIG. 8 is a schematic cross-sectional view of an alternative embodiment of the present invention.

In the embodiment shown in FIG. 8, a detent 56 for receiving the anti-rotation member 52 is formed in the central panel 12. The detent 56 is a small recess on the public side 12*a* of the central panel 12. The detent 56 may be formed in a shell press or a conversion press. By forming the detent 56 in the public side 12*a* of the central panel 12, damage to the coating on the product side 12*b* of the central panel 12 is avoided. In this embodiment, the torque required to rotate the tab 26 on the rivet 28 is increase as the anti-rotation member 52 must be deflected upwardly relative to the central panel 12 upon communication with and in order to exit the bounds of the detent 56. This action causes a frictional force by the anti-rotation member 52 on the central panel 12, thus increasing the torque required to rotate the tab 26.

Figure 9:
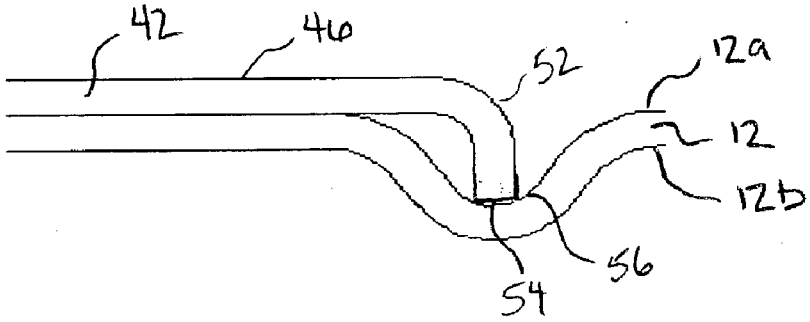
FIG. 9 is a schematic cross-sectional view of an alternative embodiment of the present invention.

It should be understood that the embodiments can be combined as illustrated in FIG. 9. In this embodiment, a length of the anti-rotation member 52 is increased so that an end portion engages a portion of the detent 56. One ordinary skilled in the art would appreciate that the can end can exhibit more than one anti-rotation member 52, more than one anti-rotation 52 fit within more than one detent 56, or any combination of the two.

In the preferred embodiment, the spring force created by the anti-rotation member 52 is increased by forming the anti-rotation member 52 from a portion of the rivet island 46. (See FIGS. 3 and 6). The decreased distance between the rivet 28 and the anti-rotation member 52 increases spring-back force. The anti-rotation member 52 can be any part or all of the void region perimeter 50 that forms the outer extent of the rivet island 46. In the case where of the void region perimeter 50 that forms the outer extent of the rivet island 46 makes up the anti-rotation member 52, the detent 56 would have a generally curvilinear shape, which would be arch-shaped or U-shaped in the examples illustrated.

Further, the anti-rotation member 52 includes a linear edge portion 54 that engages the central panel wall 12. When the void region 48 has a U-shaped configuration as illustrated in FIGS. 1–3, the linear edge portion 54 opposite the hinge region 44 is naturally available; however, when the void region 48 has a generally arch-shaped configuration as shown in FIGS. 4–6, and the rivet island 46 follows the void region's general shape, the linear edge portion 54 must be formed, typically opposite the hinge connection 44, by either shearing a portion of the rivet island 46 or bending/folding the portion of the rivet island 46 against itself.

One ordinary skilled in the art would understand that the anti-rotation member 52 can be spaced from the rivet island 46 without departing from the spirit of the invention. For instance, the anti-rotation member 52 can be any portion or portions of the tab webbing 42 including any portion or portions of the void region perimeter 50, as long as a spring force is created such that the torque required to rotate the tab is sufficiently increased. Also, the linear portion 54 of the anti-rotation member 52 can be a cut or sheared edge of metal, or any downward bend, roll, bump, bulge, protuberance, or projection of the tab 26 that engages the central panel 12 and/or fits within the detent 56 in such a way as to reduce or eliminate the likelihood of the tab 26 rotating about the rivet 28. Accordingly, the dimensions, including size and shape, of the anti-rotation member 52 and/or the dimensions, including size, shape, and depth, of the detent 56 can be varied to achieve the desired result, as long as the tab 26 and the anti-rotation member 52 do not adversely affect can end handling, container stacking, can end opening, and the like.

Furthermore, one ordinary skilled in the art would understand that the principles of the present invention are readily adaptable to LOEs as well as the SOT ends shown in the drawings, and could be provided with food container ends as well.

Figure 10:
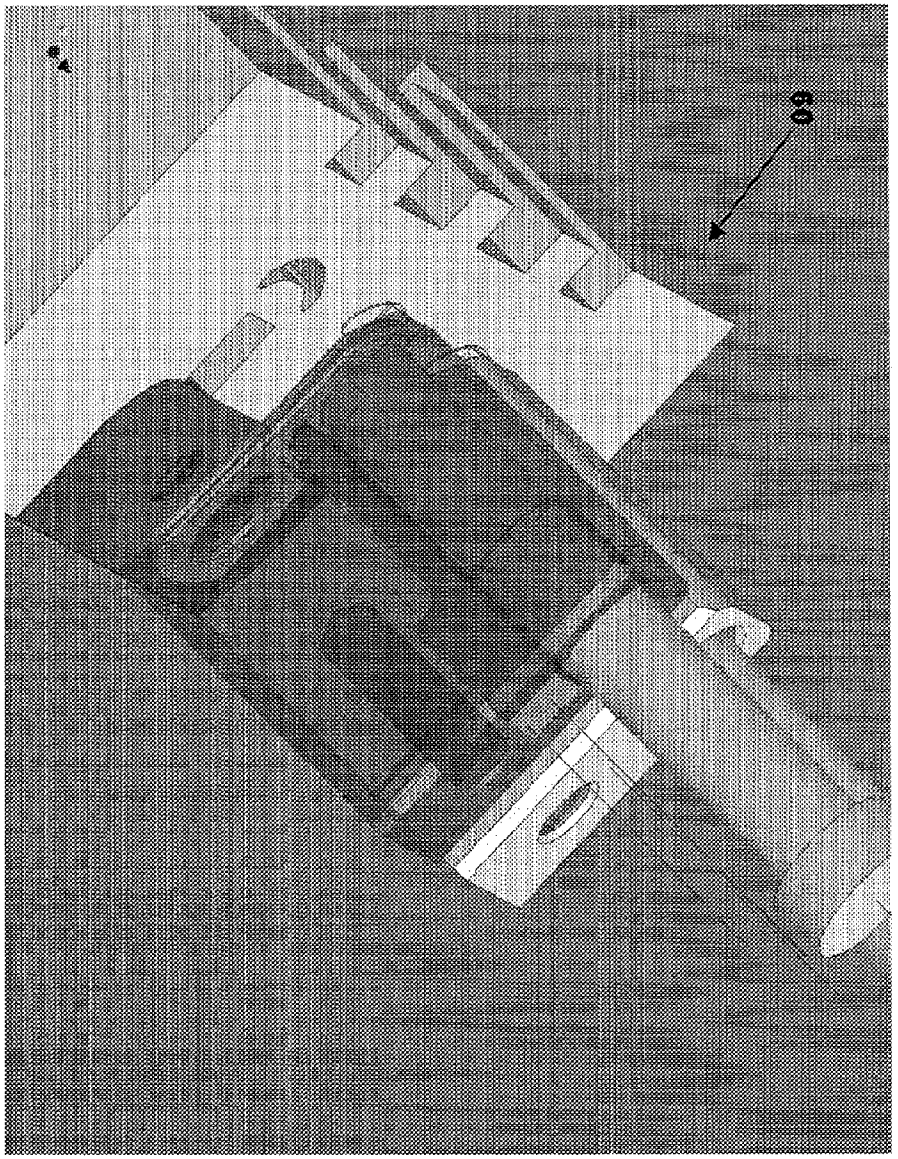
FIG. 10 is a perspective view of tooling for forming a tab of the present invention.
Figure 11:
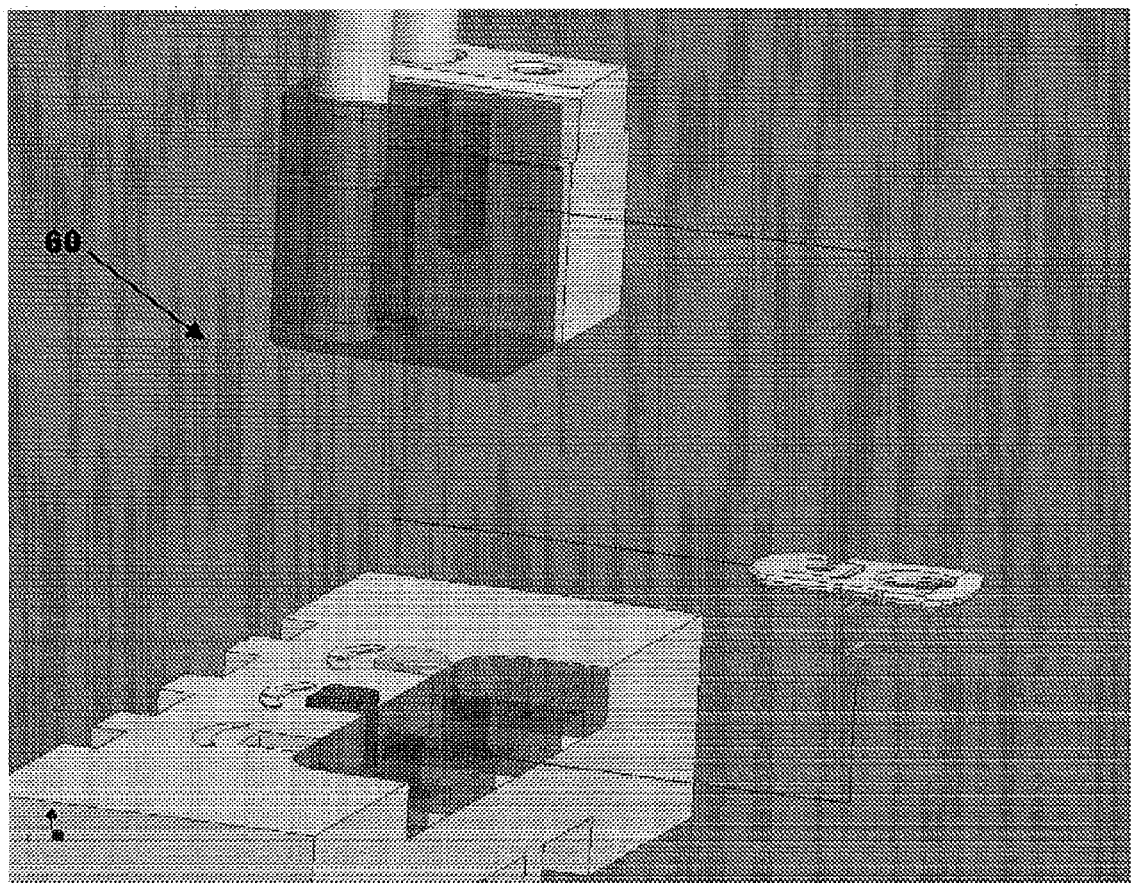
FIG. 11 is an exploded perspective view of the tooling of FIG. 10.
Figure 12:
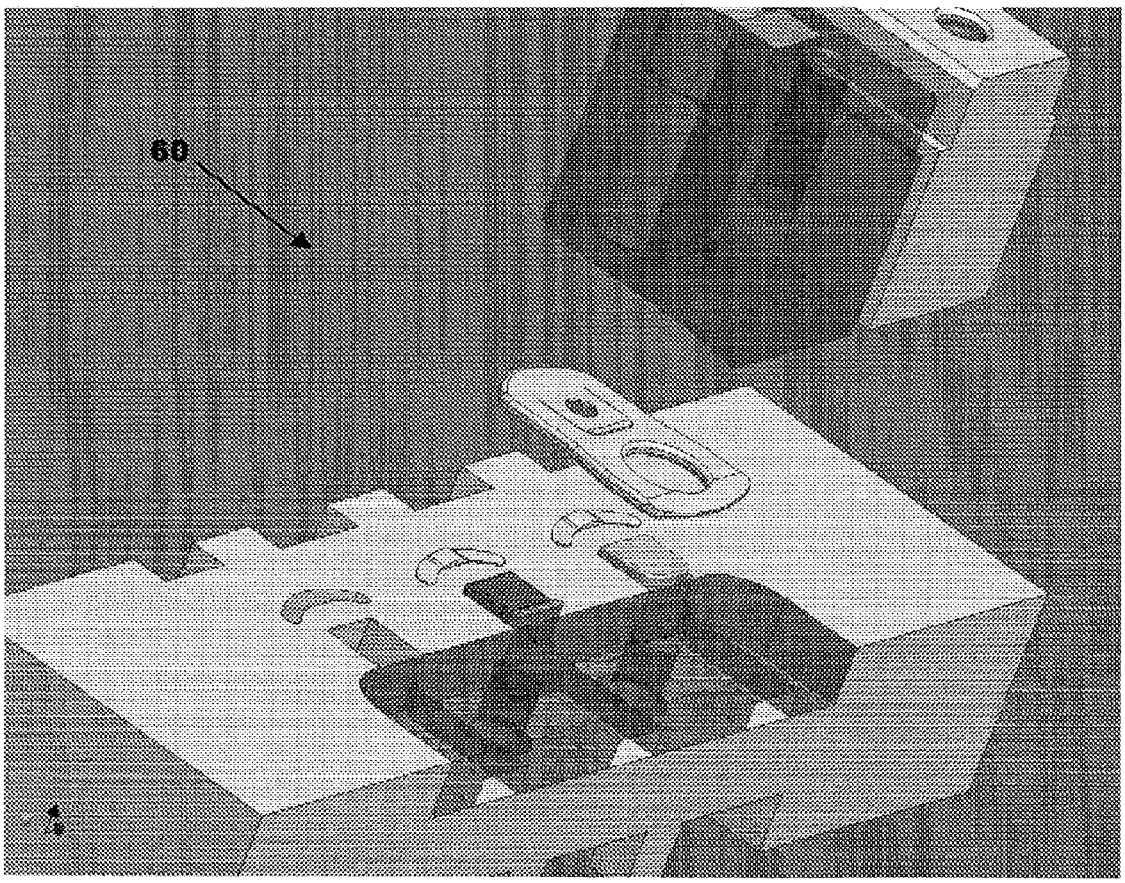
FIG. 12 is an alternate perspective view of the tooling of FIG. 10.

An example of a method of manufacturing the anti-rotation member 60 is illustrated in FIGS. 10–12. In this example, an upper tool strikes a portion of the tab webbing. The tab is forced against a lower tool having an upward protrusion, thus forming a bend in the tab webbing. After the tab is formed it is staked to the central panel in the conversion press. However, the anti-rotation member could be formed in the tab die, conversion press, or a combination of the tab die and the conversion press.

Figure 13:
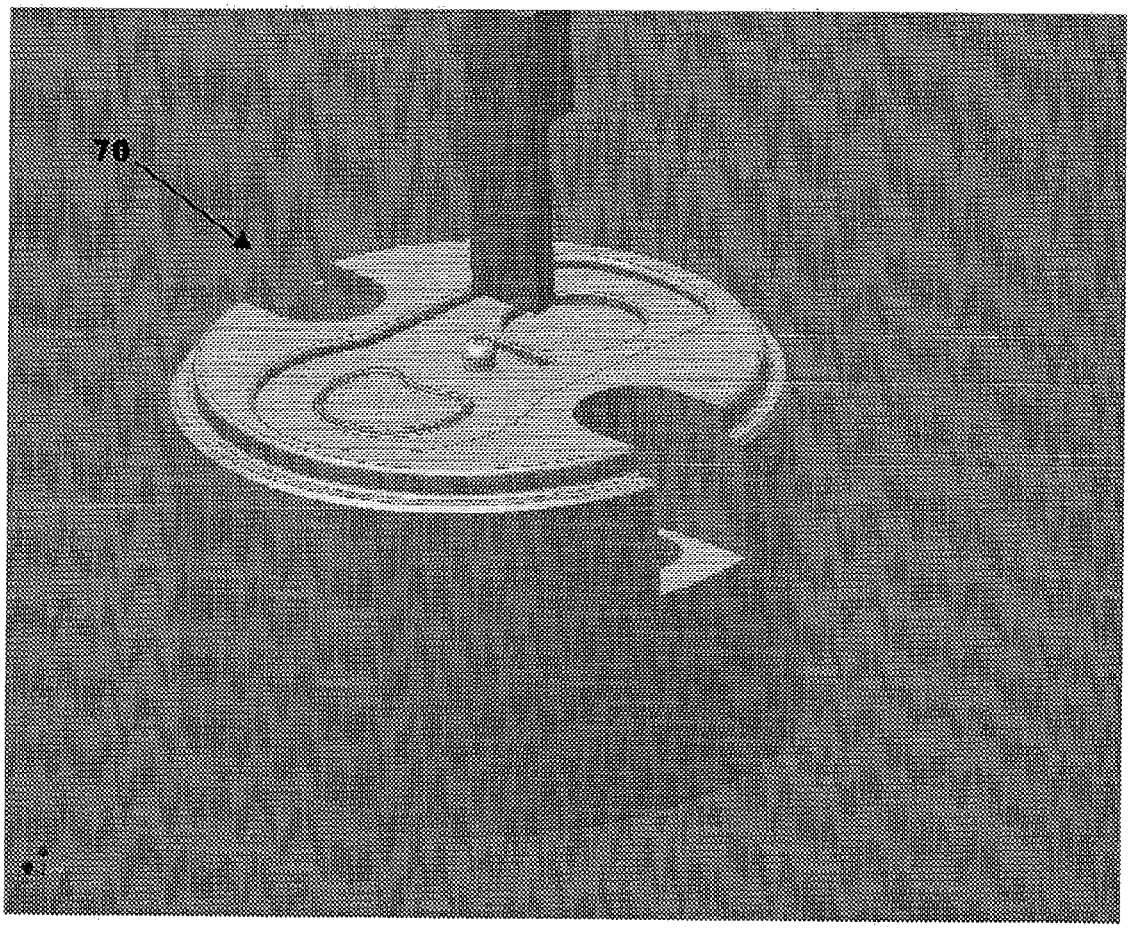
FIG. 13 is a perspective view of tooling for forming the end closure of the present invention.
Figure 14:
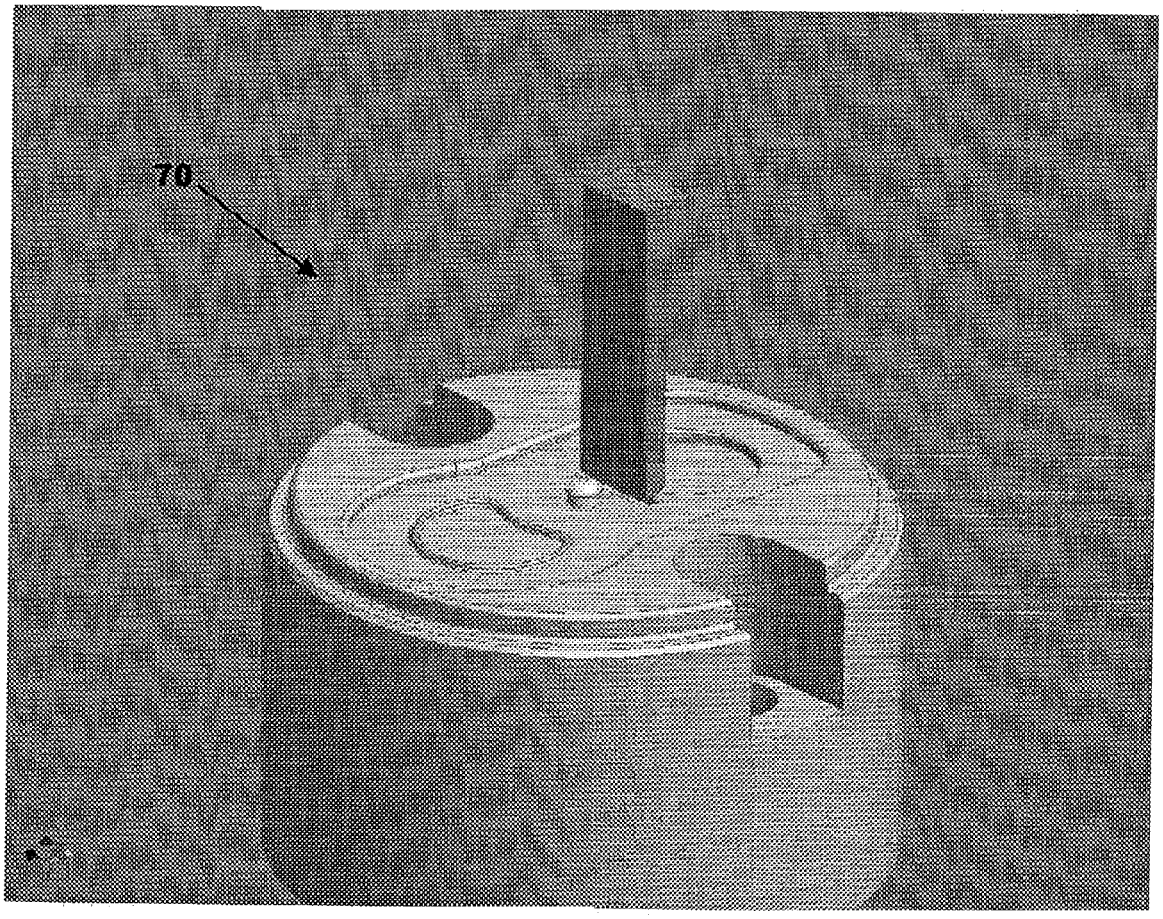
FIG. 14 is an alternate view of the tooling of FIG. 13.

An example of a method of manufacturing the detent 70 is illustrated in FIGS. 13–14. Here, a lower tool having a recess is provided. An unfinished end shell is placed on the lower tool. An upper tool contacts the public side of the can end forcing metal into the recess to form the detent.

Alternatively, the tab and detent can be formed after or during the staking operation. An upper tool forces a portion of the webbing downward on the center panel to simultaneously create the anti-rotation member and the detent.

While the invention has been described with reference to preferred embodiments, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details.

I claim:

1. An end closure for a container including a central panel wall having a product side, a public side, a rivet, and a displaceable tear panel in said central panel wall at least substantially defined by a frangible score and a non-frangible hinge segment, comprising:

a tab being attached to the public side of the central panel wall by the rivet, at least a nose portion of said tab extending over a portion of the tear panel, a lift end of said tab being opposite said tab nose;

a central webbing of said tab between said nose and said lift end, said central webbing having a downwardly extending anti-rotation member in communication with the public side of the central panel wall; and a spring force provided by said anti-rotation member against the central panel wall for increasing a torque required to rotate said tab, the spring force caused by an upward deflection of a portion of the central webbing caused by communication of the anti-rotation member with the central panel.

2. The end closure of claim 1 wherein said central webbing of said tab further comprises a rivet island surrounding said rivet and a void region to provide an exposed area of the central panel partially surrounding said rivet island, said void region defined by a void region perimeter of said central webbing, said anti-rotation member being located along a portion of said void region perimeter.

3. The end closure of claim 2 wherein said anti-rotation member is a portion of said rivet island.

4. The end closure of claim 2 wherein said portion of said void region perimeter having said anti-rotation member is spaced from said rivet island.

5. The end closure of claim 2 wherein said void region is a curvilinear opening partially surrounding the rivet at a generally equal distance from the rivet, and said anti-rotation member has a linear edge portion in communication with the central panel wall.

6. The end closure of claim 1 wherein said tab further comprises an opening defined by a void region perimeter of said central webbing and surrounding a rivet island, said rivet island being attached to a portion of said central webbing by a hinge connection, and said anti-rotation member being located along a portion of said void region perimeter located opposite said rivet island.

7. The end closure of claim 1 wherein said tab further comprises a U-shaped opening defined by a void region perimeter of said central webbing and surrounding a rivet island, said rivet island being attached to a portion of said central webbing by a hinge connection, and said anti-rotation member located on said rivet island along a portion of said void region perimeter.

8. The end closure of claim 1 wherein said tab further comprises an arch-shaped opening defined by a void region perimeter of said central webbing and surrounding a rivet island, said rivet island being attached to a portion of said central webbing by a hinge connection, and said anti-rotation member located on said rivet island along a portion of said void region perimeter.

9. The end closure of claim 8 wherein said anti-rotation member has a linear edge portion in communication with the central panel wall.

10. The end closure of claim 1 further comprising a detent, said detent located on the public side of the central panel wall in alignment with said anti-rotation member wherein said anti-rotation member is received within said detent.

11. The end closure of claim 10 wherein said central webbing of said tab further comprises a rivet island surrounding said rivet and a void region to provide an exposed area of the central panel partially surrounding said rivet island, said void region defined by a void region perimeter of said central webbing, said anti-rotation member being located along said void region perimeter.

12. The end closure of claim 11 wherein said anti-rotation member is a portion of said rivet island.

13. The end closure of claim 11 wherein said portion of said void region perimeter having said anti-rotation member is spaced from said rivet island.

14. The end closure of claim 11 wherein said void region is a curvilinear opening partially surrounding the rivet at a generally equal distance from the rivet, and said anti-rotation member has a linear edge portion in communication with the central panel wall.

15. The end closure of claim 10 wherein said tab further comprises an opening defined by a void region perimeter of said central webbing and surrounding said rivet island, said rivet island being attached to a portion of said central webbing by a hinge connection, and said downwardly extending portion is located along a portion of said void region perimeter located opposite said hinge connection.

16. The end closure of claim 10 wherein said tab further comprises a U-shaped opening defined by a void region perimeter of said central webbing and surrounding said rivet island, said rivet island being attached to a portion of said central webbing by a hinge connection, and said downwardly extending portion located on said rivet island along a portion of said void region perimeter.

17. The end closure of claim 10 wherein said tab further comprises an arch-shaped opening defined by a void region perimeter of said central webbing and surrounding said rivet island, said rivet island being attached to a portion of said central webbing by a hinge connection, and said downwardly extending portion located on said rivet island along a portion of said void region perimeter.

18. The end closure of claim 17 wherein said anti-rotation member has a linear edge portion in communication with the central panel wall.

19. An end closure for a container including a central panel wall having a product side, a public side, a rivet, and a displaceable tear panel in said central panel wall at least substantially defined by a frangible score and a non-frangible hinge segment, comprising:

a tab being attached to the public side of the central panel wall by the rivet, at least a nose portion of said tab extending over a portion of the tear panel, a lift end of said tab being opposite said tab nose;

a central webbing of said tab between said nose and said lift end, said central webbing having an anti-rotation member extending downwardly relative to the public side of the central panel wall, said anti-rotation member having a linear edge portion in communication with the central panel wall.

20. The end closure of claim 19 further comprising a spring force provided by said anti-rotation member against the central panel wall.

21. The end closure of claim 19 wherein said central webbing of said tab further comprises a rivet island surrounding said rivet and a void region to provide an exposed area of the central panel partially surrounding said rivet island, said void region defined by a void region perimeter of said central webbing, said anti-rotation member being located along a portion of said void region perimeter.

22. The end closure of claim 21 wherein said anti-rotation member is a portion of said rivet island.

23. The end closure of claim 21 wherein said portion of said void region perimeter having said anti-rotation member is spaced from said rivet island.

24. The end closure of claim 19 a detent formed on the public side of the central panel, said detent in alignment with said anti-rotation member wherein said anti-rotation member is received within said detent wherein a torque required to rotate said tab is increased.

25. The end closure of claim 19 wherein said tab further comprises an opening defined by a void region perimeter of said central webbing and surrounding a rivet island, said rivet island being attached to a portion of said central webbing by a hinge connection, and said anti-rotation member being located along a portion of said void region perimeter located opposite said rivet island.

26. The end closure of claim 19 wherein said tab further comprises a U-shaped opening defined by a void region perimeter of said central webbing and surrounding a rivet island, said rivet island being attached to a portion of said central webbing by a hinge connection, and said anti-rotation member located on said rivet island along a portion of said void region perimeter.

27. The end closure of claim 19 wherein said tab further comprises an arch-shaped opening defined by a void region perimeter of said central webbing and surrounding a rivet island, said rivet island being attached to a portion of said central webbing by a hinge connection, and said anti-rotation member located on said rivet island along a portion of said void region perimeter.

* * * * *

UNITED STATES PATENT AND TRADEMARK OFFICE

CERTIFICATE OF CORRECTION

PATENT NO. : 6,951,293 B2
APPLICATION NO. : 10/349153
DATED : October 4, 2005
INVENTOR(S) : Michel Thibaut It is certified that error appears in the above-identified patent and that said Letters Patent is hereby corrected as shown below:

Title Page, Illustrating Figures should be deleted, and replaced with new Title Page. (Attached)

(12) United States Patent
Thibaut

(10) Patent No.: US 6,951,293 B2
(45) Date of Patent: Oct. 4, 2005

(54) END CLOSURE WITH ANTI-ROTATION TAB

(75) Inventor: Michel Thibaut, Parc le Bilaa (FR)

(73) Assignee: Rexam Beverage Can Company, Chicago, IL (US)

( * ) Notice: Subject to any disclaimer, the term of this patent is extended or adjusted under 35 U.S.C. 154(b) by 14 days.

(21) Appl. No.: 10/349,153

(22) Filed: Jan. 22, 2003

(65) Prior Publication Data

US 2004/0140309 A1 Jul. 22, 2004

(51) Int. Cl.[7] ..... B65D 17/34
(52) U.S. Cl. ..... 220/268; 220/270; 220/906
(58) Field of Search ..... 220/268, 269, 220/270, 906

(56) References Cited

U.S. PATENT DOCUMENTS

| | | | | |
|---|---|---|---|---|
| 3,780,902 | A | | 12/1973 | Hole |
| 3,941,276 | A | | 3/1976 | Patel |
| 3,967,754 | A | | 7/1976 | Ostrem |
| 4,276,993 | A | | 7/1981 | Hasegawa |
| 4,363,419 | A | | 12/1982 | Walz, Sr. |
| 4,416,389 | A | | 11/1983 | Wilkinson et al. |
| D289,017 | S | | 3/1987 | Spangler et al. |
| 4,733,793 | A | | 3/1988 | Moen |
| 4,804,104 | A | | 2/1989 | Moen |
| 4,930,658 | A | | 6/1990 | McEldowney |
| 5,129,541 | A | | 7/1992 | Voigt et al. |
| 5,131,555 | A | * | 7/1992 | DeMars et al. ..... 220/269 |
| 5,224,618 | A | * | 7/1993 | Garbiso ..... 220/269 |
| 5,248,053 | A | * | 9/1993 | Lundgren ..... 220/269 |
| 5,494,184 | A | | 2/1996 | Noguchi et al. |
| 5,655,678 | A | * | 8/1997 | Kobayashi ..... 220/269 |
| 5,741,105 | A | | 4/1998 | Schubert et al. |
| 5,799,816 | A | | 9/1998 | Schubert |
| 6,053,349 | A | | 4/2000 | Griggs, Jr. et al. |

FOREIGN PATENT DOCUMENTS

| | | |
|---|---|---|
| JP | 08053131 | 2/1996 |
| WO | WO 0071430 | 11/2000 |

* cited by examiner

*Primary Examiner*—John A. Ricci
(74) *Attorney, Agent, or Firm*—Wallenstein Wagner & Rockey, Ltd.

(57) ABSTRACT

An end closure for a container providing a tab with increased resistance to rotation upon a rivet is disclosed. The end closure has a central panel wall having a product side, a public side, a rivet, and a displaceable tear panel in the central panel wall at least substantially defined by a frangible score and a non-frangible hinge segment. A tab is attached to the public side of the central panel wall by the rivet. At least a nose portion of the tab extends over a portion of the tear panel. A lift end of the tab is opposite the tab nose. The tab has a central webbing between the nose and the lift end. The central webbing has an anti-rotation member in communication with the public side of the central panel wall. The anti-rotation member provides a spring force against the central panel wall.

27 Claims, 8 Drawing Sheets

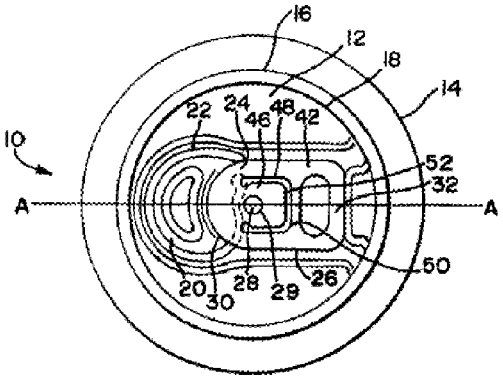

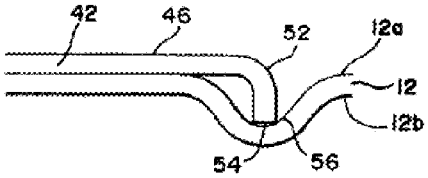

UNITED STATES PATENT AND TRADEMARK OFFICE

CERTIFICATE OF CORRECTION

PATENT NO. : 6,951,293 B2
APPLICATION NO. : 10/349153
DATED : October 4, 2005
INVENTOR(S) : Michel Thibaut It is certified that error appears in the above-identified patent and that said Letters Patent is hereby corrected as shown below:

Delete Drawing Fig. 1, 2 & 3, Replace Figs. 1, 2, and 3 with formal drawings of Figs. 1, 2, and 3 as shown below:

FIG.1

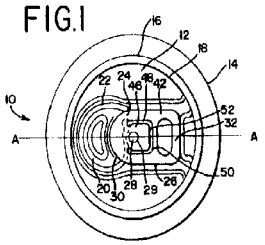

FIG.2

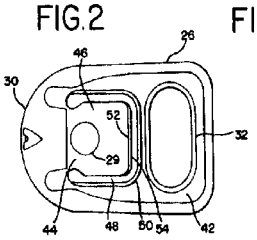

FIG.3

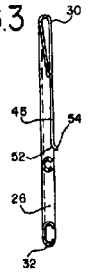

Delete Drawing Fig. 4, 5 & 6, Replace Figs. 4, 5, and 6 with formal drawings of Figs. 4, 5, and 6 as shown below:

FIG.4

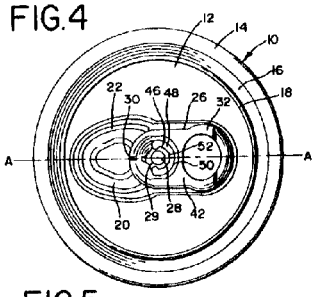

FIG.5

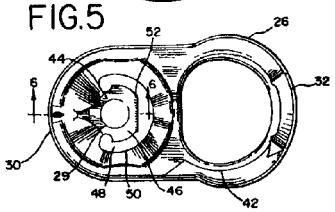

FIG.6

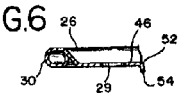

UNITED STATES PATENT AND TRADEMARK OFFICE

CERTIFICATE OF CORRECTION

PATENT NO. : 6,951,293 B2
APPLICATION NO. : 10/349153
DATED : October 4, 2005
INVENTOR(S) : Michel Thibaut It is certified that error appears in the above-identified patent and that said Letters Patent is hereby corrected as shown below:

Delete Drawing Fig. 7, 8 & 9, Replace Figs. 7, 8, and 9 with formal drawings of Figs. 7, 8, 9, and 10 as shown below:

FIG.7

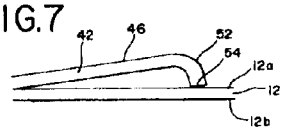

FIG.8

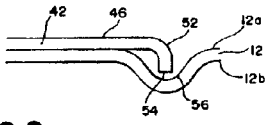

FIG.9

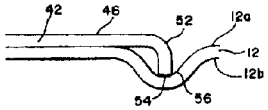

FIG.10

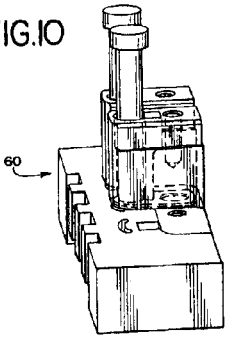

Delete Drawing Fig. 10, Replace Fig. 10 with formal drawings of Figs. 11 and 12 as shown below:

FIG.11

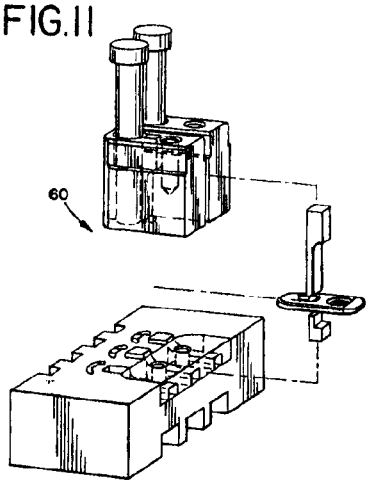

FIG.12

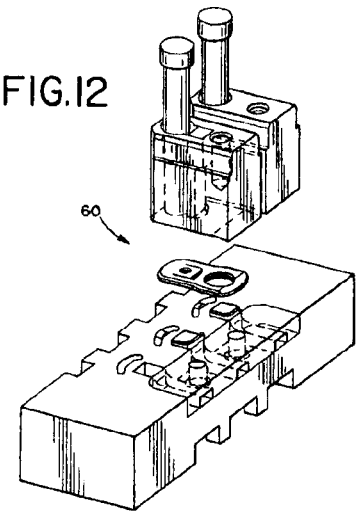

UNITED STATES PATENT AND TRADEMARK OFFICE

CERTIFICATE OF CORRECTION

PATENT NO. : 6,951,293 B2
APPLICATION NO. : 10/349153
DATED : October 4, 2005
INVENTOR(S) : Michel Thibaut It is certified that error appears in the above-identified patent and that said Letters Patent is hereby corrected as shown below:

Delete Drawing Fig. 11, Replace Fig. 11 with formal drawings of Figs. 13 and 14 as shown below:

FIG.13

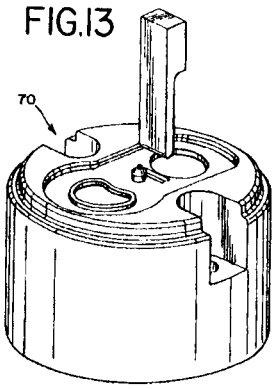

FIG.14

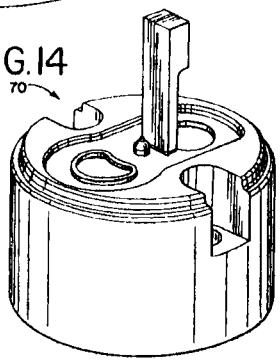

Drawing Sheet 6 of 8 Delete Fig. 12 (now appearing on Drawing Sheet 4)

Drawing Sheet 7 of 8 Delete Fig. 13 (now appearing on Drawing Sheet 5)

Drawing Sheet 8 of 8 Delete Fig. 14 (now appearing on Drawing Sheet 5)

UNITED STATES PATENT AND TRADEMARK OFFICE

CERTIFICATE OF CORRECTION

PATENT NO. : 6,951,293 B2
APPLICATION NO. : 10/349153
DATED : October 4, 2005
INVENTOR(S) : Michel Thibaut It is certified that error appears in the above-identified patent and that said Letters Patent is hereby corrected as shown below:

Col. 9, line 20 After "claim 19" insert -- further comprising --

Signed and Sealed this

Twenty-fourth Day of June, 2008

JON W. DUDAS
*Director of the United States Patent and Trademark Office*